US008526644B2

(12) United States Patent
Aarts et al.

(10) Patent No.: US 8,526,644 B2
(45) Date of Patent: Sep. 3, 2013

(54) BEAMFORMING SYSTEM COMPRISING A TRANSDUCER ASSEMBLY

(75) Inventors: Ronaldus Maria Aarts, Eindhoven (NL); Pieter Jacob Snijder, Eindhoven (NL)

(73) Assignee: Koninklijke Philips N.V., Eindhoven (NL)

( * ) Notice: Subject to any disclaimer, the term of this patent is extended or adjusted under 35 U.S.C. 154(b) by 502 days.

(21) Appl. No.: 12/602,685

(22) PCT Filed: Jun. 4, 2008

(86) PCT No.: PCT/IB2008/052182

§ 371 (c)(1), (2), (4) Date: Dec. 2, 2009

(87) PCT Pub. No.: WO2008/149296

PCT Pub. Date: Dec. 11, 2008

(65) Prior Publication Data

US 2010/0177909 A1 Jul. 15, 2010

(30) Foreign Application Priority Data

Jun. 8, 2007 (EP) ..... 07109890

(51) Int. Cl.
*H04R 5/02* (2006.01)

(52) U.S. Cl.
USPC ..... 381/304; 381/300; 381/303; 381/103

(58) Field of Classification Search
USPC ..... 381/77, 79–81, 92, 89, 335, 300, 381/304–305, 103
See application file for complete search history.

(56) References Cited

U.S. PATENT DOCUMENTS

| | | | | |
|---|---|---|---|---|
| 4,481,661 | A | 11/1984 | Spector | |
| 5,386,478 | A * | 1/1995 | Plunkett | 381/103 |
| 5,867,123 | A | 2/1999 | Geyh et al. | |
| 6,239,348 | B1 | 5/2001 | Metcalf | |
| 6,513,622 | B1 | 2/2003 | Gelow et al. | |
| 7,113,609 | B1 * | 9/2006 | Neidich et al. | 381/305 |
| 7,796,775 | B2 * | 9/2010 | Oxford et al. | 381/386 |
| 8,170,245 | B2 * | 5/2012 | Neidich et al. | 381/305 |
| 2004/0070967 | A1 | 4/2004 | Kennedy | |
| 2005/0068019 | A1 * | 3/2005 | Nakamura et al. | 323/355 |
| 2005/0152557 | A1 * | 7/2005 | Sasaki et al. | 381/58 |
| 2005/0175190 | A1 | 8/2005 | Tashev et al. | |
| 2005/0195988 | A1 | 9/2005 | Tashev et al. | |
| 2006/0002110 | A1 | 1/2006 | Dowling et al. | |
| 2007/0094423 | A1 | 4/2007 | Atkinson | |

* cited by examiner

*Primary Examiner* — Disler Paul

(57) ABSTRACT

A beamforming system (ASY) comprises a modular transducer assembly (MTA) composed of a plurality of transducer modules (TM1, TM2, TM3). A transducer module comprises a plurality of interfaces having different geometrical orientations. An interface allows the transducer module to be physically coupled to another transducer module. In a reconnaissance phase, the beamforming system identifies transducer modules that are present in the modular transducer assembly (MTA). The beamforming system further identifies a structure in accordance with which the transducer modules have been physically coupled to each other. In a configuration phase, the beamforming system defines a signal relationship between the transducer modules on the basis of identification data that has been obtained in the reconnaissance phase and a desired directional response pattern.

15 Claims, 7 Drawing Sheets

BEAMFORMING SYSTEM COMPRISING A TRANSDUCER ASSEMBLY

FIELD OF THE INVENTION

An aspect of the invention relates to a beamforming system that comprises a transducer assembly. The beamforming system may be in the form of, for example, an audio system that comprises several loudspeakers, which radiate acoustic energy in one or more particular directions. Other aspects of the invention relates to a transducer module, a method of operating a beamforming system, and a computer program product.

BACKGROUND OF THE INVENTION

Beamforming is a technique that allows achieving a particular directional response pattern by means of a plurality of transducers. In a transmission mode, beamforming allows a bundling of radiated power in a particular direction in which a signal is to be sent. That is, beamforming allows a transmitter to have a desired directional radiation pattern. Conversely, in a reception mode, beamforming allows maximum sensitivity in a particular direction from which a desired signal arrives. That is, beamforming allows a receiver to have a desired directional sensitivity pattern. Beamforming can be regarded as a spatial filtering. Beamforming can be done with, for example, acoustic waves and radio waves of any wavelength. Acoustic beamforming may involve an array of loudspeakers or microphones, or both. Radio beamforming may involve an array of antennas.

In general, beamforming involves defining a particular signal relationship between transducers that form part of a beamforming system. A transducer has a particular geometrical position within the beamforming system. The particular signal relationship, which is required to achieve a particular directional response pattern, depends on the respective geometrical positions that the respective transducers have. A suitably programmed processor may calculate the particular signal relationship that is required on the basis of the following input data: the particular direction response pattern that is desired and the respective geometrical positions of the respective transducers. The suitably programmed processor may also take into account respective characteristics of the respective transducers. The particular signal relationship is typically defined by providing a particular transfer function for each individual transducer. In that case, the suitably programmed processor calculates the respective transfer functions for the respective transducers.

US patent application published under number US 2005/0175190 A1 discloses a self-descriptive microphone array that includes a memory, which contains a device description. The device description includes parametric information that defines operational characteristics and configuration of the microphone array. Once connected, the microphone array provides its device description to a computing device. Sound processing software residing within the computing device is then automatically configured for appropriately interacting with one or more audio signals provided by the microphone array. The microphone array may perform a self calibration for automatically updating the device description. The self calibration is performed either upon connection to the computing device, or upon regular or user-specified intervals.

SUMMARY OF THE INVENTION

It is an object of the invention to provide a beamforming system that can be customized in a cost-efficient manner. The independent claims define various aspects of the invention. The dependent claims define additional features for implementing the invention to advantage.

The invention takes the following points into consideration. A particular application may require a particular transducer assembly in terms of number of transducers and in terms of structure. For example, a particular application may require seven transducers, which are arranged in an H-form structure. Another particular application may require nine transducers, which are arranged as a square of numeral 3×3 transducers. There are numerous different transducer assemblies that may be tested for a given application.

In principle, it is possible to design and manufacture a range of transducer assemblies for a range of different applications. For each transducer assembly, a device description may be established and stored in a memory, similar to what is described in the aforementioned prior art. However, it may occur that the range of transducer assemblies does not comprise any specimen that is sufficiently well suited for a particular application. In that case, a new transducer assembly has to be designed and manufactured for that particular application. This is relatively expensive. It may also occur that it is not known beforehand which transducer assembly is best suited for a particular application. In that case, several transducer assemblies need to be made available for the purpose of testing. This will generally be rather cumbersome and, therefore, expensive.

In accordance with the invention, a beamforming system comprises a modular transducer assembly composed of a plurality of transducer modules. A transducer module comprises a plurality of interfaces having different geometrical orientations. An interface allows the transducer module to be physically coupled to another transducer module. In a reconnaissance phase, the beamforming system identifies transducer modules that are present in the modular transducer assembly. The beamforming system further identifies a structure in accordance with which the transducer modules have been physically coupled to each other. In a configuration phase, the beamforming system determines a signal relationship between the transducer modules on the basis of identification data that has been obtained in the reconnaissance phase and a desired directional response pattern.

Accordingly, the invention allows building a custom transducer assembly for a specific application by appropriately assembling transducer modules. Numerous transducer assemblies of different structure can be built with a given set of transducer modules. Moreover, a given transducer assembly can easily be tailored by adding or removing transducer modules. Importantly, a beamforming system in accordance with the invention automatically identifies transducer modules that are present in a transducer assembly and identifies the structure thereof. The beamforming system can derive from this information the respective geometrical positions of the respective transducers. The beamforming system can therefore automatically define a signal relationship between the respective transducers that provides a desired directional response pattern. In contrast with to the prior art, there is no need to design and manufacture a range of different transducer assemblies, in which each individual transducer assembly carries a device description. For those reasons, the invention allows a beamforming system that can be customized in a cost-efficient manner.

An implementation of the invention advantageously comprises one or more of following additional features, which are described in separate paragraphs that correspond with individual dependent claims.

An interface of a transducer module preferably comprises a coupling element via which the transducer module can establish a data link with another transducer module.

A transducer module preferably comprises a register for storing a module identifier, which uniquely identifies the transducer module within the modular transducer assembly.

The transducer module preferably transmits the identifier to a neighboring transducer module via an interface in association with an interface identifier, which identifies the interface via which the identifier is transmitted to the neighboring transducer module. The neighboring transducer module preferably identifies an interface via which the identifier is received.

A beamforming system preferably comprises a driver that injects a token in the modular transducer assembly. A transducer module detects the token and, in response thereto, provides its unique module identifier in association with an interface identifier, which identifies an interface via which the token has been received, and another interface identifier, which identifies an interface via which the token will leave the transducer module.

The driver preferably includes an identification number in the token, which has an initial value. The transducer module preferably establishes the unique identifier on the basis of the identification number that is present in the token when the token arrives at the transducer module, and modifies the identification number in the token before the token leaves the transducer module.

A transducer module can preferably set an interface in one of the following modes: a reception mode, a transmission mode, and an inactive mode.

An interface of a transducer module preferably comprises a pair of magnetic coupling elements for physically coupling the transducer module to another transducer module, which is equally provided with a pair of magnetic coupling elements. Accordingly, the one and the other transducer module are physically coupled to each other by means of magnetic attraction.

The transducer module preferably transfers a supply power, which is received via the pair of magnetic coupling elements, to another pair of magnetic coupling elements that forms part of another interface of the transducer module.

A detailed description with reference to drawings illustrates the invention summarized hereinbefore, as well as the additional features.

DETAILED DESCRIPTION OF EMBODIMENTS

Figure 1:
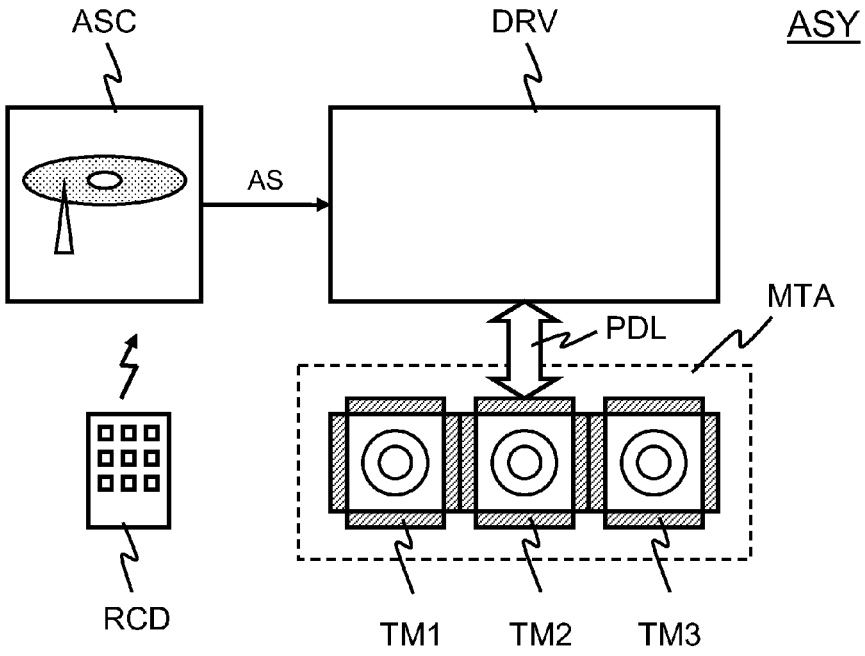
FIG. 1 is a block diagram that illustrates an audio rendering system, which comprises a modular transducer assembly with various loudspeakers.

FIG. 1 illustrates an audio rendering system ASY. The audio rendering system ASY comprises an audio source ASC, an audio driver DRV, a remote-control device RCD, and a modular transducer assembly MTA. The modular transducer assembly MTA is coupled to the audio driver DRV via a power and data link PDL. The modular transducer assembly MTA is composed of various transducer modules, which may be coupled together in numerous different fashions.

FIG. 1 illustrates a basic example in which three transducer modules TM1, TM2, TM3 are coupled together so that these form an array. Each transducer module comprises at least one loudspeaker. For example, in case each transducer module comprises a single loudspeaker, the modular transducer assembly MTA provides an array of three loudspeakers. It should further be noted that FIG. 1 illustrates a single modular transducer assembly for the sake of simplicity. The audio rendering system ASY may actually comprise two modular transducer assemblies for stereo sound reproduction. In case of surround sound reproduction, there may be even more modular transducer assemblies.

The audio rendering system ASY basically operates as follows. A user may select a particular audio rendering profile by means of the remote-control device RCD. The particular audio rendering profile that user has selected may require the modular transducer assembly MTA to emit acoustic energy in accordance with a particular directional radiation pattern. For example, the particular directional radiation pattern may be such that the acoustic energy is substantially emitted in a particular direction. This is often referred to as beamforming.

The audio driver DRV configures each transducer module so that the modular transducer assembly MTA provides the particular directional radiation pattern of interest. This will be explained in greater detail hereinafter. Once the modular transducer assembly MTA has been configured, the audio driver DRV processes an audio signal AS, which the audio source ASC provides, so as to apply a processed audio signal to the modular transducer assembly MTA via the power and data link PDL. In response, the modular transducer assembly MTA produces an acoustic signal, which is emitted in accordance with the particular directional radiation pattern of interest.

Figure 2:
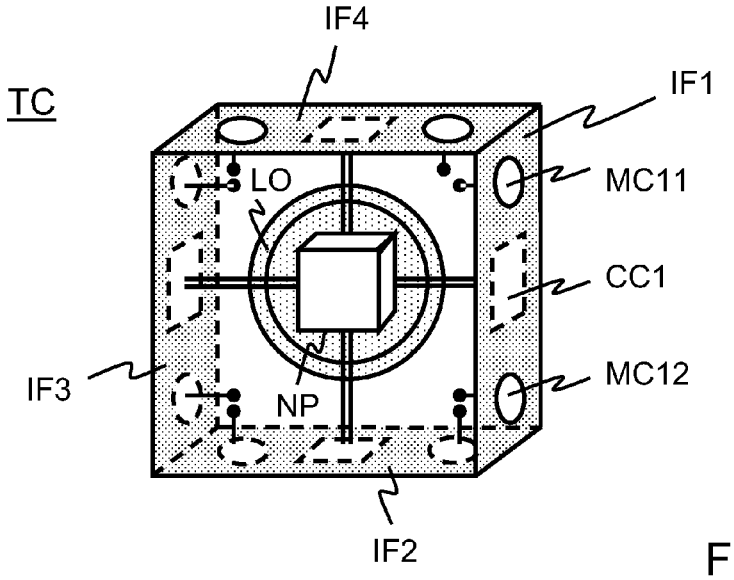
FIG. 2 is a pictorial diagram that illustrates a transducer module, which forms part of the modular transducer assembly.

FIG. 2 illustrates a view of a transducer module TM, which may represent each of the three transducer modules illustrated in FIG. 1. The transducer module TM is in the form of, for example, a rectangular box. The transducer module TM comprises four interfaces IF1, IF2, IF3, IF4, a nodal processor NP, and a loudspeaker LO. Each interface corresponds with a particular side of the rectangular box. Each interface is individually coupled to the nodal processor NP. Each interface comprises a pair of magnetic coupling elements and a capacitive coupling element. For example, FIG. 2 illustrates that interface IF1 comprises a pair of magnetic coupling elements MC11, MC12, and a capacitive coupling element CC1.

The transducer module TM has given standard dimensions. The loudspeaker LO has a given geometrical location within the transducer module TM. For example, the loudspeaker LO may be located in the center of the transducer module TM. Accordingly, in case the transducer module TM is coupled to another transducer module of identical type, a loudspeaker distance can be determined based on the given standard dimensions of the respective transducer modules, which are identical.

The same applies in case the transducer module TM is coupled to another transducer module of different type, which has different standard dimensions. The loudspeaker distance can be determined on the basis of the respective standard dimensions of the respective transducer modules, which may be different. A transducer module may also comprise several loudspeakers, each of which has a given geometrical location within the transducer module. Loudspeaker distances can be determined in a similar fashion based on information that the transducer module is coupled to another transducer module, and given the respective geometrical locations of the loudspeakers in the one and the other transducer module.

The pair of magnetic coupling elements of an interface allows the transducer module TM to be physically coupled to another transducer module. To that end, an interface of the transducer module TM is brought into registration with an interface of the other transducer module. One magnetic coupling element of the pair, which has a given polarity, faces a magnetic coupling element of opposite polarity of the other transducer module. Similarly, the other magnetic coupling element of the pair faces another magnetic coupling element of opposite polarity of the other transducer module. Accordingly, the respective transducer modules are physically coupled by means of magnetic attraction. The magnetic coupling elements of each pair preferably have opposite magnetic polarities. In that case, two transducer modules can only be coupled to each other if the two transducer modules have a particular orientation with respect to each other.

In addition, the pair of magnetic coupling elements serves to distribute a supply power throughout the modular transducer assembly MTA. For example, the transducer module TM illustrated in FIG. 2 may receive a supply power via the pair of magnetic coupling elements MC11, MC12 of interface IF1. The transducer module TM may pass the supply power to another transducer module via the pair of magnetic coupling elements of another interface IF2, IF3, or IF4. One magnetic coupling element of a pair carries a supply voltage, whereas the other magnetic coupling element of the pair constitutes signal ground. Accordingly, the magnetic coupling elements of a pair have opposite electrical polarities. There is preferably a predefined relationship between the opposite electrical polarities and the opposite magnetic polarities of each pair of magnetic coupling elements. This allows a "fool proof" assembly.

The capacitive coupling element of an interface allows a data transfer between the transducer module TM and another transducer module, which is coupled physically thereto. Let it be assumed that the transducer module TM is physically coupled to the other transducer module via interface IF1 illustrated in FIG. 2. In that case, the capacitive coupling element CC1 will face a capacitive coupling element of the other transducer module. Accordingly, a capacitive coupling between the two transducer modules is established via which data can be transferred the two respective transducer modules.

Figure 3:
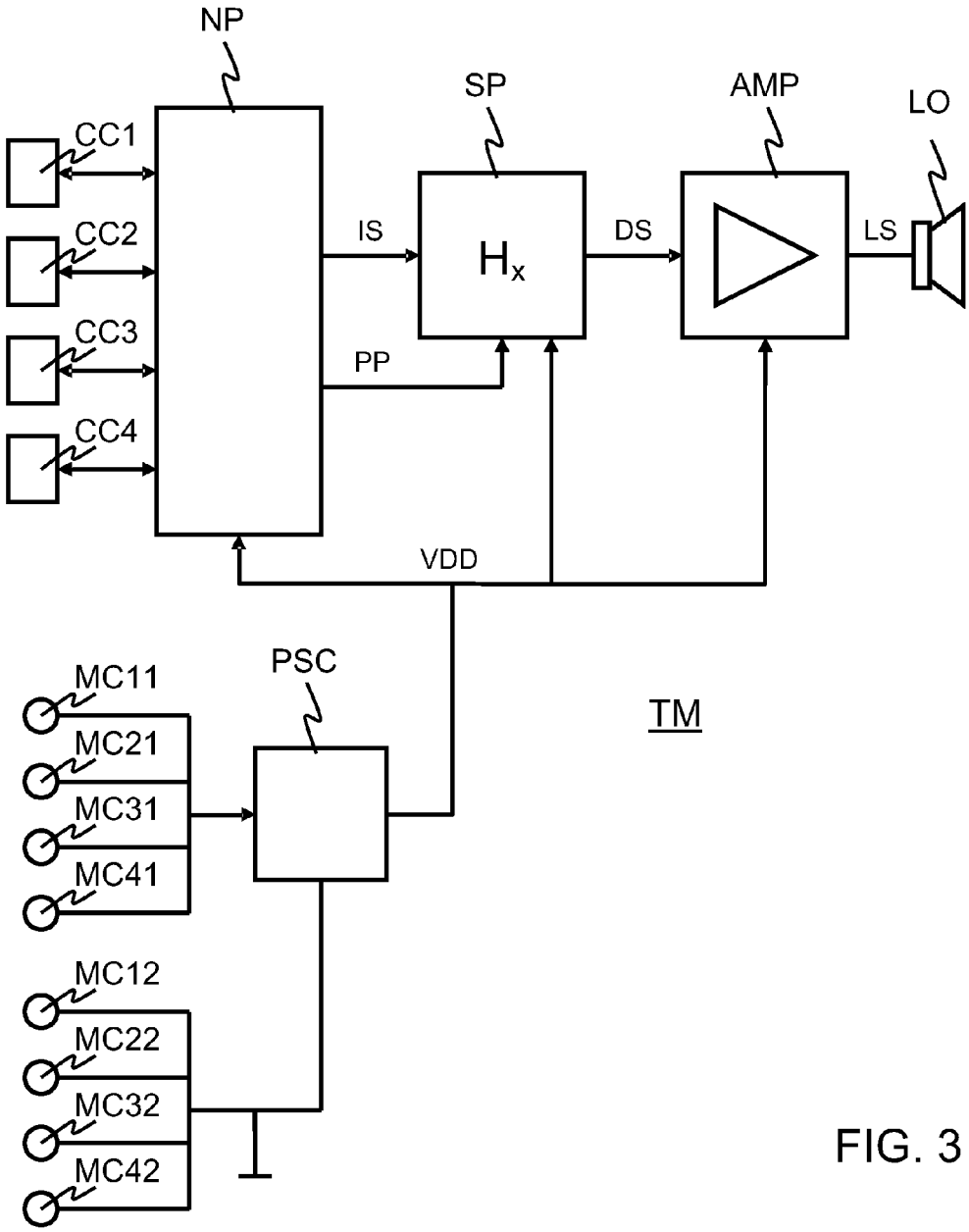
FIG. 3 is a block diagram that illustrates a transducer module.

FIG. 3 illustrates the transducer module TM in the form of block diagram. In addition to the nodal processor NP and the loudspeaker LO, the transducer module TM comprises various other functional entities: a signal processor SP, an amplifier AMP, and a power supply circuit PSC. The nodal processor NP is coupled to the respective capacitive coupling elements CC1, CC2, CC3, CC4 of the transducer module TM, each of which belongs to a particular interface IF1, IF2, IF3, IF4. The power supply circuit PSC is coupled to the respective pairs of magnetic coupling elements MC11, MC12; MC21, MC22; MC31, MC32; MC41, MC42, each of which belongs to particular interface IF1, IF2, IF3, IF4. Magnetic coupling elements of identical electrical polarity are grouped together to form a supply voltage line or a signal ground line, whichever applies. In FIG. 3, magnetic coupling elements MC11, MC21, MC31, MC 41 form the supply voltage line and magnetic coupling elements MC12, MC22, MC32, MC 42 form the signal ground line. The power supply circuit PSC provides an internal power supply voltage VDD, which is derived from a power supply voltage that the transducer module TM receives.

The transducer module TM basically operates as follows when rendering audio. The nodal processor NP receives the processed audio signal, which the audio driver DRV applies to the modular transducer assembly MTA as mentioned hereinbefore with reference to FIG. 1. The nodal processor NP derives an input signal IS for the signal processor SP from the processed audio signal. The input signal IS may be a particular component of the processed audio signal, such as, for example a left channel component or a right channel component. The input signal IS may also be identical to the processed audio signal. The signal processor SP processes the input signal IS in accordance with a particular transfer function $H_x$ so as to obtain a local driver signal DS. The amplifier AMP amplifies the local driver signal DS so as to obtain a loudspeaker signal LS, which is applied to the loudspeaker LO.

Prior to the rendering of audio, the nodal processor NP applies processing parameters PP to the signal processor SP. The processing parameters PP define the transfer function $H_x$, which the signal processor SP implements. There are several factors that determine the transfer function H. One factor is the particular directional radiation pattern, which is associated with the audio rendering profile that user has selected. Another factor that determines the transfer function $H_x$ is the geometrical position of the transducer module TM within the modular transducer assembly MTA. Yet another factor that determines the transfer function $H_x$ is the electro-acoustic properties of the transducer module TM. The nodal processor NP may determine the transfer function $H_x$ on the basis of these factors. Alternatively, the audio driver DRV may determine the transfer function $H_x$ on the basis of these factors. In the following description, it will be assumed that the latter alternative applies.

Figure 4A:
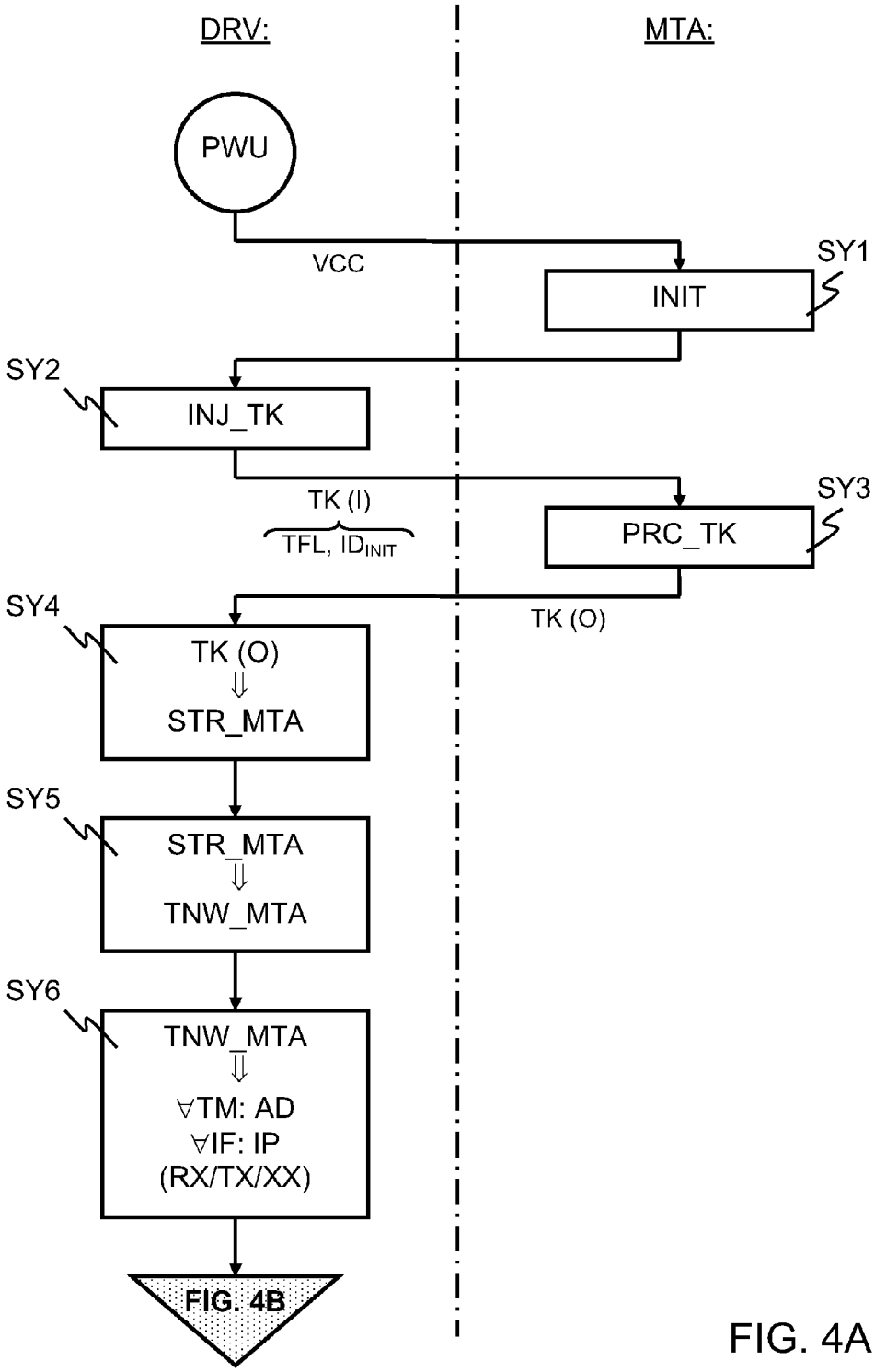
FIGS. 4A and 4B are flow chart diagram that illustrates a series of steps, which steps are carried out in the audio rendering system.
Figure 4B:
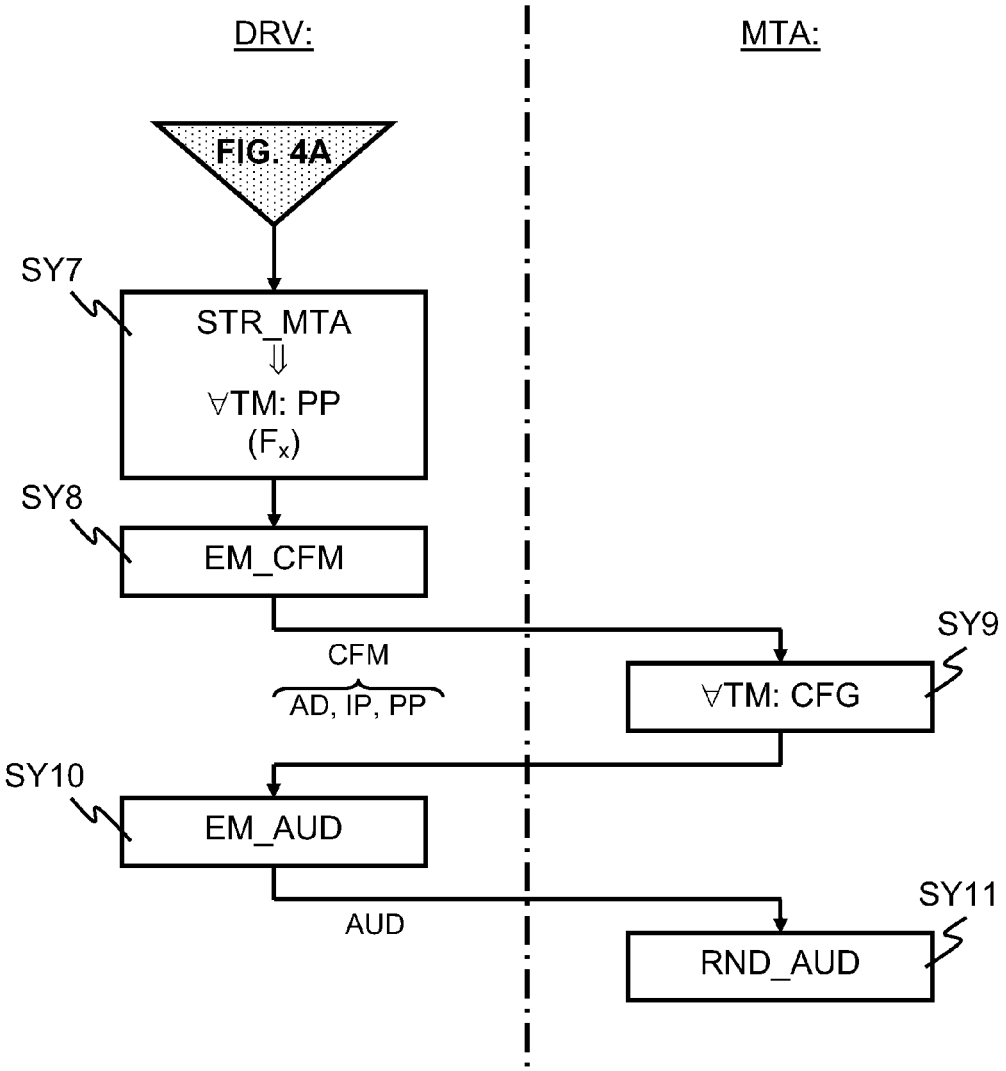

FIGS. 4A and 4B illustrate a series of system steps SY1-SY11 that the audio rendering system ASY carries out when the audio driver DRV is switched on. FIGS. 4A and 4B are divided into a left-hand part and a right-hand part, which are associated with the audio driver DRV and the modular transducer assembly MTA, respectively. System steps that are carried out in the audio driver DRV are presented in the left-hand part. System steps that are carried out within the modular transducer assembly MTA are represented in the right-hand part.

The modular transducer assembly MTA starts to receive a power supply voltage VCC from the audio driver DRV when the audio driver DRV is switched on (PWU). In response, the modular transducer assembly MTA carries out system step SY1 in which each transducer module is brought into an initial state (INIT).

System steps SY2-SY3 constitute a reconnaissance phase, in which transducer modules that are present in the modular transducer assembly MTA are identified. The audio system ASY further identifies a structure in accordance with which the transducer modules have been physically coupled to each other.

In system step SY2, the audio driver DRV injects a token TK into the modular transducer assembly MTA (INJ_TK). The token TK is a unique data word that can be recognized as such by each transducer module within the modular transducer assembly MTA. To that end, the token TK may comprise, for example, a unique preamble. The token TK that the audio driver DRV injects (I) into the modular transducer assembly MTA comprises a transit flag TFL, which is reset, and an initial identification number $ID_{INIT}$.

In system step SY3, the token TK travels, as it were, through the modular transducer assembly MTA (PRC_TK). The token TK visits each transducer module. A transducer module receives a unique identifier when the token TK visits the transducer module for the first time. A transducer module may append one or more elements to the token TK while the token TK resides within the transducer module TM. The one or more elements that are appended to the token TK may provide information about the transducer module concerned and its geometrical position within the structure of the modular transducer assembly MTA.

The token TK grows in size while traveling through the modular transducer assembly MTA, carrying more and more information about its structure and the transducer modules comprised therein. The token TK will leave the modular transducer assembly MTA, and return to the audio driver DRV, once the token TK has visited each transducer module. The token TK will then comprise sufficient information about the modular transducer assembly MTA in terms of its structure and the transducer modules comprised therein. This will be explained in greater detail hereinafter.

System steps SY4-SY9 constitute a configuration phase, in which each transducer module is configured such that the modular transducer assembly MTA provides the directional radiation pattern of interest. In system step SY4, the audio driver DRV determines the geometrical structure of the transducer assembly on the basis of the token TK that the modular transducer assembly MTA has returned (TK (O) ⇒ STR_MTA). That is, the audio driver DRV establishes a map, as it were, of the modular transducer assembly MTA on the basis of reconnaissance data comprised in the token TK that the modular transducer assembly MTA has returned.

In system step SY5, the audio driver DRV establishes a transmission network through the modular transducer assembly MTA based on the structure thereof (STR_MTA ⇒ TNW_MTA). The transmission network preferably provides, for each transducer module, the shortest possible data path from the audio driver DRV to the transducer module concerned. The transmission network can be obtained by drawing connection lines, as it were, from each transducer module to the audio driver DRV. The transmission network will typically comprise one or more branches, each of which corresponds with a particular transmission module.

In system step SY6, the audio driver DRV establishes various network configuration parameters for each transducer module within the modular transducer assembly MTA (TNW_MTA⇒ ∀TM: AD, ∀IF: IP). To that end, the audio driver DRV assigns a unique address AD to each transducer module. The unique address AD preferably relates to Cartesian coordinates, which represent the geometrical position of the transducer module. In addition, the audio driver DRV determines a parameter IP for each interface. Such an interface parameter IP determines whether the interface concerned should operate in a reception mode or a transmission mode, or whether the interface should be inactive (RX/TX/XX). For example, let it be assumed that one interface of a transducer module TM is in the reception mode, whereas another interface is in the transmission mode, and that the other interfaces are inactive. In that case, the transducer module constitutes a single connection line between the one and the other interface. Let it now be assumed that one interface of the transducer module is in the reception mode and that several other interfaces are in the transmission mode. In that case, the transducer module constitutes a branch in the transmission network.

In system step SY7, which is illustrated in FIG. 4B, the audio driver DRV establishes the processing parameters PP for the signal processor SP in each transducer module (STR_MTA⇒ ∀TM: PP ($F_x$)). The audio driver DRV establishes the processing parameters PP on the basis of several factors as explained hereinbefore with reference to FIG. 3. These factors include the geometrical structure of the modular transducer assembly MTA and the geometrical position of the transducer module therein, which the audio driver DRV has previously derived from the token TK that the modular transducer assembly MTA has returned. Another factor is the directional radiation pattern of interest, which is associated with the audio rendering profile that the user has selected.

In system step SY8, the audio driver DRV emits successive configuration messages CFM to the modular transducer assembly MTA (EM_CFM). Each configuration message CFM is destined for a particular transducer module. The first configuration message CFM is destined for the transducer module that is directly coupled to the audio driver DRV. The second configuration message CFM is destined for a transducer module that is directly coupled to the aforementioned transducer module. That is, the transmission network determines an order in which the configuration messages CFM are emitted. A configuration message CFM comprises various elements that the audio driver DRV has established as described hereinbefore. These elements include the unique address AD, the interface parameters IP, and the processing parameters PP.

In system step SY9, the modular transducer assembly MTA is configured in a step-by-step fashion by means of the configuration messages CFM that the audio driver DRV successively emits (∀TM: CFG). Each particular transducer module processes the configuration message CFM intended for the particular transducer module. In doing so, the particular transducer module assumes the unique address AD, which is comprised in the configuration message CFM, sets each interface in the reception mode or the transmission mode, or deactivates the interface, and applies the processing parameters PP to the signal processor SP within the transducer module TM.

System steps SY10-SY11 constitute a rendering phase, which is entered into when the configuration phase has been completed. In the rendering phase, the audio rendering system ASY renders the audio signal that the audio source ASC provides as illustrated in FIG. 1. In system step SY10, the audio driver DRV applies the processed audio signal to the modular transducer assembly MTA (EM_AUD). In system step SY11, each transducer module renders the processed audio signal in accordance with the transfer function $H_x$ that specifically applies to the transducer module, as explained hereinbefore with reference to FIG. 3 (RND_AUD).

Figure 5A:
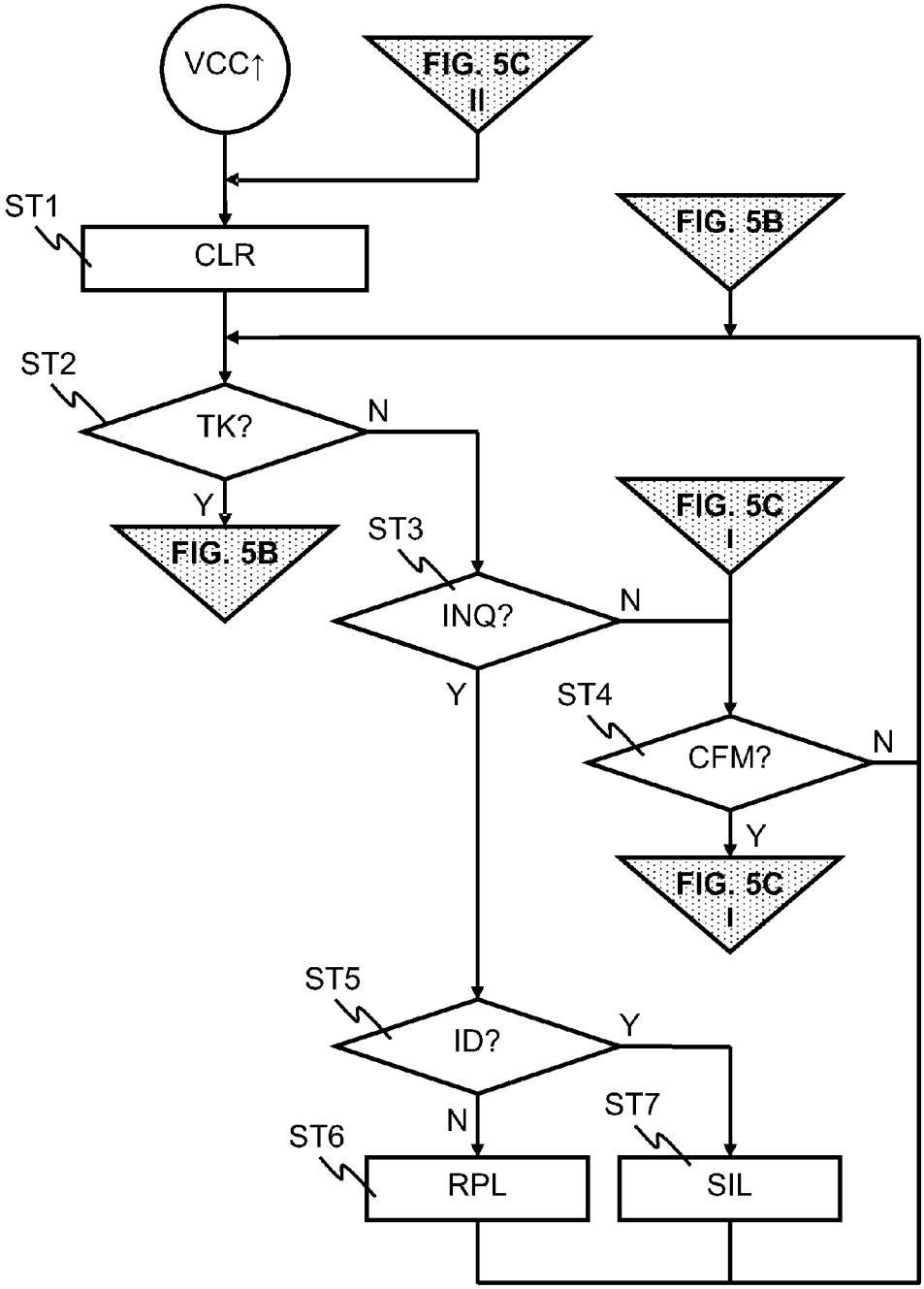
FIGS. 5A, 5B, and 5C are flow chart diagram that illustrates a series of steps, which steps are carried out in a transducer module.
Figure 5B:
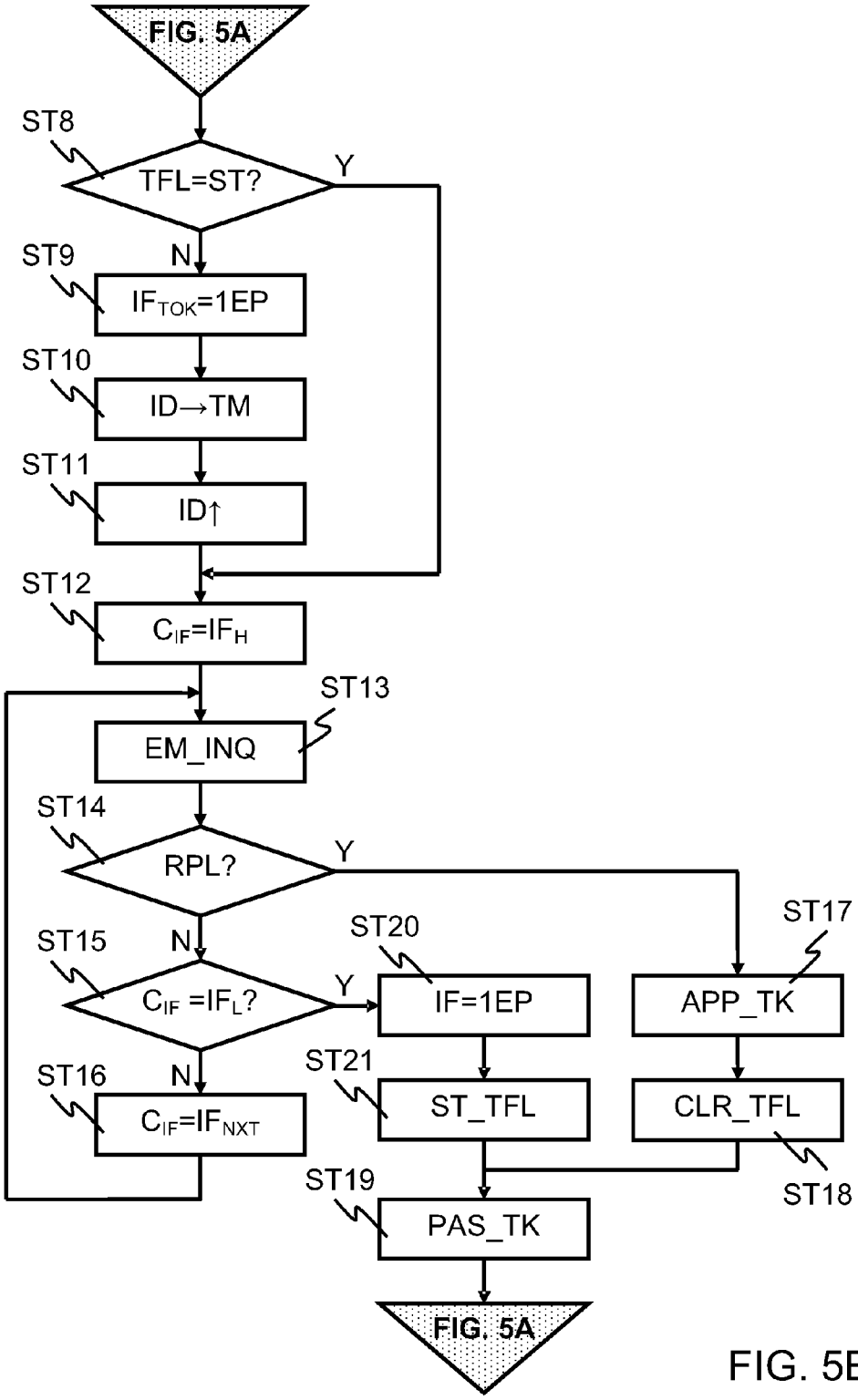
Figure 5C:
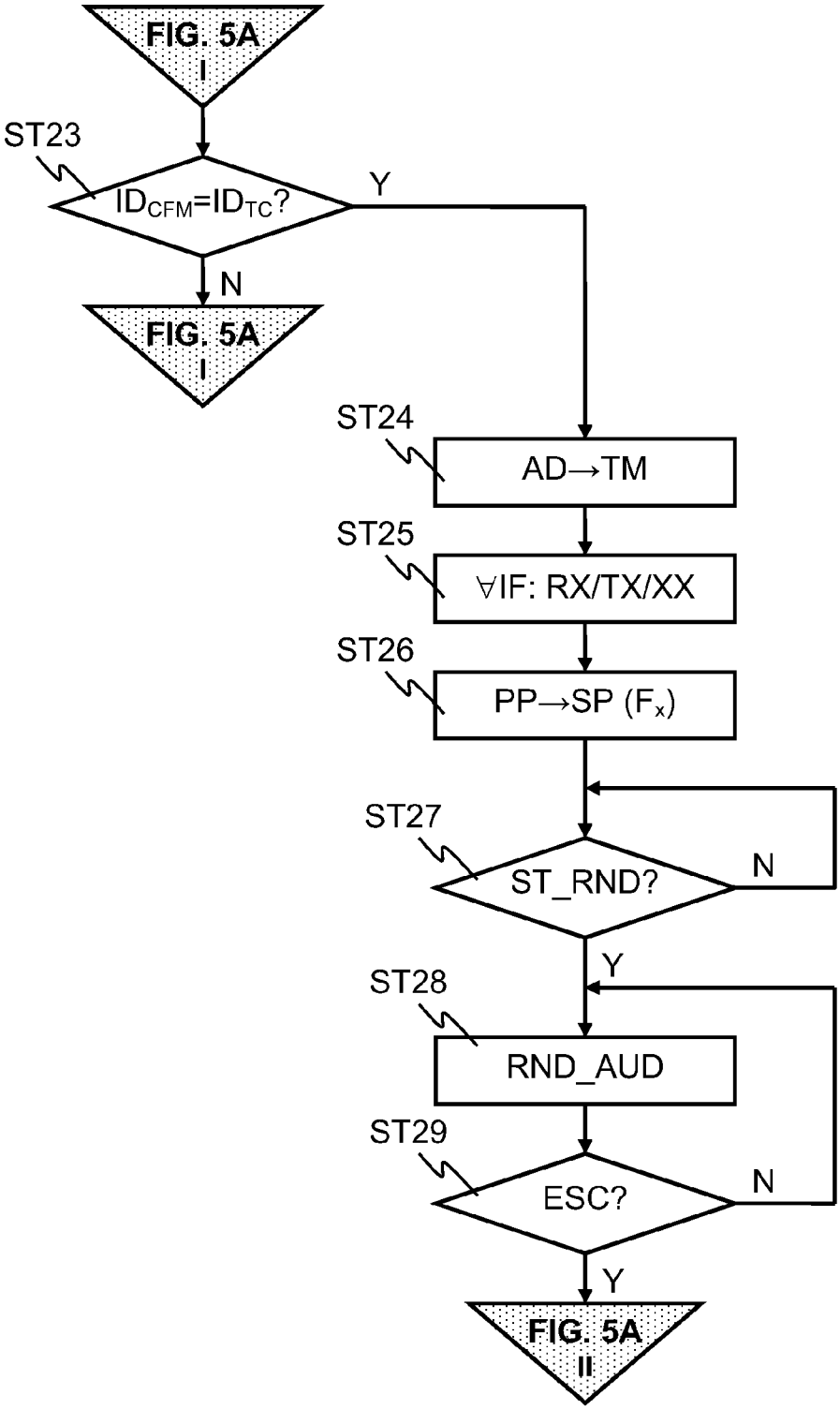

FIGS. 5A, 5B, and 5C illustrate a series of transducer steps ST1-ST29, which each transducer module individually carries out upon receiving the power supply voltage VCC from the audio driver DRV (VCC↑). The series of transducer steps ST1-ST29 provides a detailed example of a manner in which the token TK is processed within the modular transducer assembly MTA. The nodal processor NP within the transducer module TM illustrated in FIGS. 2 and 3 may carry out the transducer steps, which are described hereinafter. Alternatively, another processor may carry out the transducer steps, either independently or in combination with the nodal processor NP.

In transducer step ST1, the transducer module concerned clears various data registers, which serve to store configuration elements, such as, the identification number, the unique address AD, the interface parameters IP, and the processing parameters PP (CLR). That is, the transducer module is brought into an initial state, which corresponds with system step SY1 illustrated in FIG. 4A. In the initial state, each interface is in the reception mode. Stated otherwise, the transducer module is listening on all sides.

In transducer step ST2, the transducer module establishes whether the token TK is received or not (TK?). In case the token TK has arrived at the transducer module, the transducer module carries out transducer steps ST8, ST9, . . . that are illustrated in FIG. 5B. These transducer steps will be described hereinafter. In case the transducer module has not received the token TK, transducer step ST3 is carried out.

In transducer step ST3, the transducer module establishes whether an inquiry from another transducer module is received or not (INQ?). In case no inquiry is received, the transducer module proceeds to transducer step ST4. In the latter step, the transducer module establishes whether a configuration message CFM is received or not (CFM?). In case a configuration message CFM has arrived at the transducer module, the transducer module carries out transducer step ST23 and, optionally, transducer steps ST24, ST25, . . . , which are illustrated in FIG. 5C. These steps will be discussed hereinafter. In case no configuration message CFM is received, transducer step ST2 is carried out anew.

In summary, in transducer steps ST2-ST4, the transducer module continuously monitors whether any of the following types of data is received: the token TK, an inquiry INQ from another transducer module, or a configuration message CFM. In case a particular type of data is received, the transducer module takes an appropriate action. It is noted that the token TK and the inquiry INQ occur in the reconnaissance phase, which comprises system steps SY2, SY3, as mentioned hereinbefore with reference to FIG. 4. The configuration message CFM occurs in the configuration phase, which comprises system steps SY8 and SY9.

In case the transducer module receives an inquiry, which is detected in transducer step ST3, the transducer module carries out transducer step ST5. In the latter step, the transducer module checks whether an identification number has been assigned to the transducer module or not (ID?). In case the transducer module does not have an identification number yet, the transducer module sends a reply to the inquiry in transducer step ST6 (RPL). The reply is sent via the interface on which the inquiry arrived, so as to ensure that only the transducer module that has sent the inquiry will receive the reply. In case the transducer module has an identification number, no reply is sent. That is, the transducer module remains silent in transducer step ST7 (SIL). Accordingly, the transducer module that has sent the inquiry can establish whether the transducer module has already been assigned an identification number, or not.

Let it be assumed that the transducer module has received the token TK, which is detected in transducer step ST3. In that case, the transducer module carries out transducer step ST8, which is illustrated in FIG. 5B. In the latter step, the transducer module checks whether the transit flag TFL within the token TK has been set or not (TFL=ST?). In case the transit flag TFL has not been set, this signifies that the token TK arrives for the first time at the transducer module. In that case, the transducer module carries out transducer steps ST9-ST11 before arriving at transducer step ST12. In case the transit flag TFL has been set, this signals that the transducer module has previously received the token TK; it is not the first time. In that case, the transducer module directly proceeds to carry out transducer step ST12.

In transducer step ST9, the transducer module stores an identification of the interface on which the token TK is received, as a first entry point ($IF_{TOK}$=1EP). Accordingly, the transducer module can remember, as it were, the interface on which the token TK has arrived at the transducer module for the first time. This is the first entry point.

In transducer step ST10, the transducer module assumes an identification number that is comprised in the token TK (ID→TM). In a manner of speaking, the token TK stamps the transducer module with the identification number that the token TK carries. In transducer step ST11, the transducer module increments the identification number by one unit (ID↑). Accordingly, the identification number, which was present in the token TK when the token arrived at the transducer module, is effectively replaced by an incremented identification number. This new identification number will serve to stamp a transducer module that the token TK has not yet visited, if there is any such transducer module.

In transducer steps ST12-ST16, the token TK effectively seeks a way out of the transducer module. There is a predefined order of ranking, or preference, for the various interfaces of the transducer module, via which the token TK may leave the transducer module. Preferably, the same order of ranking applies to all the transducer modules within the modular transducer assembly MTA. The order of ranking as such is of no particular interest, and may be chosen arbitrarily. For example, referring to FIG. 2, the order of ranking may be as follows: IF1, IF2, IF3, IF4. That is, in geometrical terms, the order of ranking may be expressed as: right, down, left, up. The transducer module determines whether the token TK should leave via a particular interface, starting with the interface that has the highest rank.

In transducer step ST12, the transducer module selects the interface that has highest rank to constitute an interface currently under consideration ($C_{IF}=IF_H$). In transducer step ST13, the transducer module emits an inquiry via the interface currently under consideration (EM_INQ). In transducer step ST14, the transducer module assesses whether a reply to the inquiry has been received or not (RPL?). In case no reply has been received, the transducer module determines whether the interface currently under consideration is the interface that has the lowest rank ($C_{IF}=IF_L$?). This is done in transducer step ST15. In case the interface currently under consideration does not have the lowest rank, transducer step ST16 is carried out. In the latter step, the interface that is one rank lower becomes the interface currently under consideration ($C_{IF}=IF_{NXT}$). Subsequently, transducer steps ST13, ST14 are carried out anew.

Let it be assumed that the transducer module receives a reply to an inquiry via a given interface, which is detected in transducer step ST14. This means that the transducer module has a neighbor that has not yet been visited by the token TK. In that case, transducer steps ST17-ST19 are carried out.

In transducer step ST17, the transducer module appends additional information to the token TK (APP_TK). In case the token TK has visited the transducer module for the first time, this additional information may comprise the identification number that has been assigned to the transducer module. The additional information, which is appended to the token TK, may further comprise an identification of the interface via which the token TK was received, which is the first entry point, and an identification of the interface via which the token TK will leave the transducer module. The additional information may further comprise descriptor elements that provide information about functional properties or geometrical properties of the transducer module, or both.

In transducer step ST18, the transducer module clears the transit flag TFL (CLR_TFL). This signals the neighbor that he will receive the token TK for the first time. In transducer step ST19, the token TK leaves the transducer module via the interface concerned (PAS_TK). Once the token TK has left the transducer module, the transducer module carries out transducer step ST2 anew, which is illustrated in FIG. 5A.

Let it now be assumed that the transducer module did not receive any reply after having emitted inquiries via each interface. This case corresponds with a determination in transducer step ST15 that the interface currently under consideration is the interface of lowest rank. In that case, the token TK is passed to the neighboring transducer module from which the transducer module concerned has received the token TK for the first time. To that end, transducer steps ST20, ST21 are carried out. In this manner, the token TK will always find its way back to the driver DRV.

In transducer step ST20, the transducer module selects the interface that was stored as the first entry point (IF=1EP). In transducer step ST22, the transducer module sets the transit flag TFL (ST_TFL). This will signal the transducer module to which the token TK will be passed that the token TK has already visited this transducer module. Once the token TK has left the transducer module, which occurs in transducer step ST19, the transducer module carries out transducer step ST2 anew, which is illustrated in FIG. 5A.

Referring to FIG. 5A, let it be assumed that a configuration message CFM is detected in transducer step ST4. This implies that the reconnaissance phase has been completed and that the audio system is in the configuration phase. Upon detection of a configuration message CFM, the transducer module carries out transducer step ST23, which is illustrated in FIG. 5C.

Referring to FIG. 5C, in configuration step ST23, the transducer module checks whether the configuration message CFM carries an identification number that matches with the identification number that has been assigned to the transducer module in the reconnaissance phase. In case there is no match between these respective identification numbers, the configuration message CFM is intended for another transducer module in the modular transducer assembly MTA. In that case, the transducer module carries out transducer step ST4 anew, which step is illustrated in FIG. 5A.

Let it be assumed that, in transducer step ST23, the identification number in the configuration message CFM matches with the identification number of the transducer module ($ID_{CFM}$=$ID_{TC}$?). In that case, the transducer module carries out transducer steps ST24-26, which causes the transducer module to be configured appropriately.

In transducer step ST24, the transducer module assumes the address AD that is comprised in the configuration message CFM (AD→TM). The audio driver DRV has established this unique address AD as explained hereinbefore with reference to FIGS. 4A and 4B. The address AD defines a particular location within the transmission network. In transducer step ST25, each interface of the transducer module is set in the reception mode or the transmission mode, or is made inactive, in accordance with the interface parameters IP that are comprised in the configuration message CFM (∀IF: RX/TX/XX). This defines a particular role that the transducer module plays in the transmission network. In transducer step ST26, the processing parameters PP are applied to the signal processor SP illustrated in FIG. 3 (PP→SP ($F_x$)). This causes the signal processor SP to provide the transfer function $H_x$ that is required in order to obtain the directional radiation pattern of interest.

Once the transducer module has been configured, the transducer module awaits a rendering start message (ST_RND?). This occurs in transducer step ST27. The rendering start message signals the modular transducer assembly MTA that the audio driver DRV will apply the processed audio signal to the transmission network that has been formed in the configuration phase. The rendering phase begins.

In transducer step ST28, the transducer module produces an acoustic signal on the basis of the processed audio signal as described hereinbefore with reference to FIG. 3 (RND_AUD). In transducer step ST29, the transducer module monitors whether the audio driver DRV has emitted an escape signal (ESC?). The escape signal informs the transducer module that the audio driver DRV no longer applies the processed audio signal and that the audio system may be reconfigured. The rendering phase has ended. In case the transducer module has detected the escape signal, transducer step ST1 is carried out anew. This constitutes a return to zero, as it were.

The audio rendering system ASY described hereinbefore automatically configures itself, so as to provide the directional radiation pattern of interest for any given structure of the modular transducer assembly MTA. The following example may illustrate this. Let it be assumed that the modular transducer assembly MTA comprises three transducer modules TM1, TM2, TM3, as illustrated in FIG. 1. Let it further be assumed that the directional radiation pattern of interest is obtained if there is an amplitude ratio of ½:1:½ between respective loudspeaker signals in transducer modules TM1, TM2, TM3, respectively.

The following case is considered. The audio system is switched off and two transducer modules are added to the modular transducer assembly MTA: one transducer module left to transducer module TM1 and another transducer module right to transducer module TM3. Accordingly, an array of 5 transducer modules is formed, which is a new structure. The audio rendering system ASY will automatically recognize this new structure in the reconnaissance phase. Moreover, the audio rendering system ASY determines a new amplitude ratio between the respective loudspeaker signals in the five transducer modules in the configuration phase. This new amplitude ratio, which may be, for example, ⅓:⅔:1:⅔:⅓, causes the modular transducer assembly MTA to produce the directional radiation pattern of interest, notwithstanding the modification that has been made thereto.

Concluding Remarks

The detailed description hereinbefore with reference to the drawings is merely an illustration of the invention and the additional features, which are defined in the claims. The invention can be implemented in numerous different manners. In order to illustrate this, some alternatives are briefly indicated.

The invention may be applied to advantage in any type of product or method related to beamforming by means of an assembly of transducers. The audio rendering system ASY illustrated in FIG. 1 is merely an example. The invention may equally be applied to advantage in, for example, an audio recording system in which transducer modules are provided with one or more microphones. As another example, the invention may be applied to advantage in radio reception systems and radio transmission systems, in which transducer modules are provided with one or more antennas. As yet another example, the invention may be applied to advantage in ultrasound imaging systems, in which transducer modules are provided with one or more transducers for emitting ultrasound beams or for picking up ultrasound beams, or both.

There are numerous different manners in which a beamforming system in accordance with the invention can be implemented. The detailed description with reference to drawings provides an example in which respective transfer functions for respective transducer modules are implemented by means of respective signal processors that are present within the respective transducer modules. This can be regarded as a decentralized implementation. As another example, the respective transfer functions may be implemented within a driver that is external to the modular transducer assembly, such as the audio driver DRV illustrated in FIG. 1. The respective transfer functions may be implemented by means of a single signal processor, which operates in the time multiplex fashion. In such a centralized implementation, the modular transducer assembly receives a time multiplex signal comprising different time slots. Each timeslot is associated with a particular transducer module, which association can be defined in a configuration phase. A timeslot that is associated with a given transducer module carries an audio signal component that is specifically intended for the given transducer module.

There are numerous different manners in which a beamforming system in accordance with the invention can identify a structure in accordance with which transducer modules have been physically coupled to each other. The detailed description with reference to drawings provides an example in which the beamforming system identifies the structure by means of a token that is injected into the modular transducer assembly. As another example, in a reconnaissance phase, each transducer module may transmit a predefined unique identifier via each interface while operating in a duplex mode. Accordingly, each transducer module can identify its neighbor, or its neighbors, and can identify, for each neighbor, the interface via which the neighbor is physically coupled to the transducer module concerned. The transducer module that is directly coupled to a driver may provide this neighbor information to the driver and may interrogate its neighbors about the neighbor information they have collected. Subsequently, these neighbors interrogate their neighbors for the purpose of transferring neighbor information to the driver. Accordingly, the driver gradually obtains more and more information about the modular transducer assembly in a domino-like fashion.

There are numerous different manners in which a transducer module can be implemented, from a physical and an electrical point of view. FIG. 2 illustrates a basic implementation example in which the transducer module TM is a rectangular box, with four interfaces, each of which corresponds with a particular side of the rectangular box. In another implementation, the transducer module may be in the form of, for example, a hexagonal box, with six interfaces, each of which corresponds with a particular side of the hexagonal box. Numerous different shapes are possible. All what matters is that the transducer module is provided with various interfaces, each of which has a particular geometrical orientation.

There are numerous different manners in which transducer modules can be physically coupled to each other. FIG. 2 illustrates an example in which physical coupling is achieved by means of magnetic attraction. As another example, transducer modules may be physically coupled to each other by means of, for example, a click connection or any other type of mechanical fastening.

There are numerous different manners in which transducer modules can be electrically coupled to each other for the purpose of data transfer. FIG. 2 illustrates an example in which data is transferred from one to another transducer module by means of capacitive coupling. As another example, data can be transferred by means of a magnetic coupling, or by bringing two electrically conductive pads into contact with each other.

There are numerous ways of implementing functions by means of items of hardware or software, or both. In this respect, the drawings are very diagrammatic, each representing only one possible embodiment of the invention. Thus, although a drawing shows different functions as different blocks, this by no means excludes that a single item of hardware or software carries out several functions. Nor does it exclude that an assembly of items of hardware or software or both carry out a function.

The remarks made herein before demonstrate that the detailed description with reference to the drawings, illustrate rather than limit the invention. There are numerous alternatives, which fall within the scope of the appended claims. Any reference sign in a claim should not be construed as limiting the claim. The word "comprising" does not exclude the presence of other elements or steps than those listed in a claim. The word "a" or "an" preceding an element or step does not exclude the presence of a plurality of such elements or steps.

The invention claimed is:

1. A beamforming system comprising a modular transducer assembly (MTA) composed of a plurality of transducer modules (TM1, TM2, TM3), a transducer module (TM) comprising a plurality of interfaces (IF1, IF2, IF3, IF4) having different geometrical orientations, an interface allowing the transducer module to be physically coupled to another transducer module, the beamforming system being arranged to carry out:

a reconnaissance phase (SY2, SY3) in which the transducer modules that are present in the modular transducer assembly are identified by the system, and a structure in accordance with which the transducer modules have been physically coupled to each other is identified by the system; and a configuration phase (SY4-SY8) in which a signal relationship (Hx) is determined by the system between the transducer modules on the basis of identification data including information about the transducer modules and their geometric position within the structure of the modular transducer assembly that has been obtained in the reconnaissance phase and on the basis of a desired directional response pattern.

2. The beamforming system as claimed in claim 1, wherein an interface (IF1) of a transducer module (TM) comprises a coupling element (CC1) via which the transducer module can establish a data link with another transducer module.

3. The beamforming system as claimed in claim 1, wherein a transducer module comprises a register for storing a module identifier, which uniquely identifies the transducer module within the modular transducer assembly.

4. The beamforming system as claimed in claim 3, wherein the transducer module is arranged to transmit the module identifier to a neighboring transducer module via an interface in association with an interface identifier, which identifies the interface via which the module identifier is transmitted to the neighboring transducer module, the neighboring transducer module being arranged to identify an interface via which the module identifier is received.

5. The beamforming system as claimed in claim 3, comprising a driver (DRV) arranged to inject a token (TK) in the modular transducer assembly, the transducer module being arranged to detect the token and, in response thereto, to provide a unique module identifier in association with an interface identifier, which identifies an interface via which the token has been received, and another interface identifier, which identifies an interface via which the token will leave the transducer module.

6. The beamforming system as claimed in claim 5, wherein the driver (DRV) is arranged to include an identification number in the token (TK), which has an initial value, and the transducer module is arranged to establish a unique module identifier on the basis of the identification number that is present in the token when the token arrives at the transducer module, and is arranged to modify the identification number in the token before the token leaves the transducer module.

7. The beamforming system as claimed in claim 1, wherein a transducer module is arranged to set an interface (IF1) in one of the following modes: a reception mode, a transmission mode, and an inactive mode.

8. The beamforming system as claimed in claim 1, wherein an interface (IF1) of a transducer module (TM) comprises a pair of magnetic coupling elements (MC11, MC12) for physically coupling the transducer module to another transducer module, which is equally provided with a pair of magnetic coupling elements, by means of magnetic attraction.

9. The beamforming system as claimed in claim 8, wherein the transducer module (TM) is arranged to transfer a supply power, which is received via the pair of magnetic coupling elements (MC11, MC12), to another pair of magnetic coupling elements that form part of another interface (IF2, IF3, IF4) of the transducer module.

10. A transducer module (TM) for use in a beamforming system as claimed in claim 1, the transducer module comprising a plurality of interfaces (IF1, IF2, IF3, IF4) having different geometrical orientations, an interface allowing the transducer module to be physically coupled to another transducer module in multiple different orientations.

11. The beamforming system of claim 1, further comprising the configuration phase establishing various network configuration parameters including a parameter for each of said plurality of interfaces to determine whether each interface should operate in one of a reception mode, transmission mode or an inactive mode.

12. A method of operating a beamforming system comprising a modular transducer assembly (MTA) composed of a plurality of transducer modules (TM1, TM2, TM3), a transducer module (TM) comprising a plurality of interfaces (IF1, IF2, IF3, IF4) having different geometrical orientations, an interface allowing the transducer module to be physically coupled to another transducer module, the method comprising:

a reconnaissance phase (SY2, SY3) comprising identifying by the system the transducer modules that are present in the modular transducer assembly, and identifying by the system, a structure in accordance with which the transducer modules have been physically coupled to each other; and a configuration phase (SY4-SY8) in which a signal relationship (Hx) is determined by the system between the transducer modules on the basis of identification data including information about the transducer modules and their geometric position within the structure of the modular transducer assembly that has been obtained in the reconnaissance phase and on the basis of a desired directional response pattern.

13. A non-transitory computer readable medium comprising a computer program for a programmable processor, the computer program comprising a set of instructions that, when loaded into the programmable processor, causes the programmable processor to carry out the method according to claim 12.

14. A beamforming system comprising a modular transducer assembly composed of a plurality of transducer modules, a transducer module comprising a plurality of interfaces having different geometrical orientations, an interface allowing the transducer module to be physically coupled to another transducer module, the beamforming system being arranged to carry out:

a reconnaissance phase in which the transducer modules that are present in the modular transducer assembly are identified, and a structure in accordance with which the transducer modules have been physically coupled to each other is identified; and a configuration phase (SY4-SY8) in which a signal relationship (Hx) is determined by the system between the transducer modules on the basis of identification data including information about the transducer modules and their geometric position within the structure of the modular transducer assembly that has been obtained in the reconnaissance phase and on the basis of a desired directional response pattern;

wherein a transducer module comprises a register for storing a module identifier which uniquely identifies the transducer module within the modular transducer assembly, wherein the transducer module is arranged to transmit the module identifier to a neighboring transducer module via an interface in association with an interface identifier, which identifies the interface via which the module identifier is transmitted to the neighboring transducer module, the neighboring transducer module being arranged to identify an interface via which the module identifier is received.

15. A beamforming system comprising a modular transducer assembly composed of a plurality of transducer modules, a transducer module comprising a plurality of interfaces having different geometrical orientations, an interface allowing the transducer module to be physically coupled to another transducer module, a driver arranged to inject a token in the modular transducer assembly, the transducer module being arranged to detect the token and, in response thereto, to provide a unique module identifier in association with an interface identifier, which identifies an interface via which the token has been received, and another interface identifier, which identifies an interface via which the token will leave the transducer module, the beamforming system being arranged to carry out:

a reconnaissance phase in which the transducer modules that are present in the modular transducer assembly are identified, and a structure in accordance with which the transducer modules have been physically coupled to each other is identified; and a configuration phase (SY4-SY8) in which a signal relationship (Hx) is determined by the system between the transducer modules on the basis of identification data including information about the transducer modules and their geometric position within the structure of the modular transducer assembly that has been obtained in the reconnaissance phase and on the basis of a desired directional response pattern;

wherein a transducer module comprises a register for storing a module identifier which uniquely identifies the transducer module within the modular transducer assembly.

* * * * *